US007427706B1

(12) United States Patent
Wilhelm

(10) Patent No.: US 7,427,706 B1
(45) Date of Patent: Sep. 23, 2008

(54) DRUMSTICK

(76) Inventor: Robert Wilhelm, 6635 No. Baltimore Ave., Suite 230, Portland, OR (US) 97203

( * ) Notice: Subject to any disclaimer, the term of this patent is extended or adjusted under 35 U.S.C. 154(b) by 0 days.

(21) Appl. No.: 11/367,574

(22) Filed: Mar. 3, 2006

(51) Int. Cl.
*G10D 13/02* (2006.01)

(52) U.S. Cl. ..... 84/422.4

(58) Field of Classification Search ..... 84/422.2
See application file for complete search history.

(56) References Cited

U.S. PATENT DOCUMENTS

| | | | | | |
|---|---|---|---|---|---|
| 3,137,194 | A * | 6/1964 | Simpson, Jr. | ..... | 84/422.4 |
| 3,150,555 | A * | 9/1964 | Sage | ..... | 84/422.4 |
| 5,520,090 | A * | 5/1996 | Eagle | ..... | 84/411 P |
| 5,728,958 | A * | 3/1998 | Vater | ..... | 84/422.4 |
| 5,730,662 | A * | 3/1998 | Rens | ..... | 473/300 |
| 6,310,278 | B1 * | 10/2001 | Butler | ..... | 84/422.4 |

* cited by examiner

*Primary Examiner*—Kimberly R Lockett

(57) ABSTRACT

The present invention is a drumstick for striking an instrument to produce a musical sound. An elongated shaft may have a contact end and a butt end. The butt end may be tapered to a tip. The butt end may have a groove therein with an O-ring disposed in the groove.

10 Claims, 1 Drawing Sheet

DRUMSTICK

BACKGROUND OF THE INVENTION

This invention relates to devices used to strike a drum, a cymbal or other instrument to produce sound such as musical sound. The new drumstick may have one or more O-rings inserted in grooves in the butt end or it may have a rubber type material as a hand end material.

Drumsticks made of wood or other material that generally have an elongated constant diameter shaft with an instrument contact end having a generally oval end may be known in the art. The handle end or gripping portion of a drumstick may usually have a constant diameter; although, various contoured handles may also have been used. Rings may also have been placed on the surface or in grooves on drumsticks, but with no particular location designed.

SUMMARY OF THE INVENTION

The present invention is directed to devices for striking an instrument to produce a musical sound. An elongated shaft may have a contact end and a butt end. The butt end may be tapered to a tip. The butt end may have a groove therein with an O-ring disposed in the groove.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
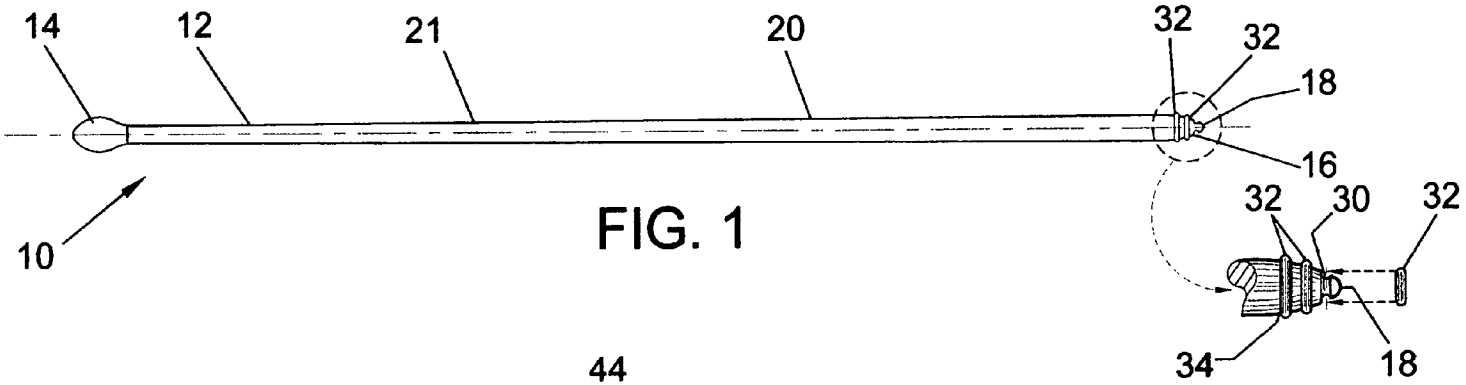
FIG. 1 illustrates a side view of a drumstick according to an embodiment of the invention.
Figure 2:
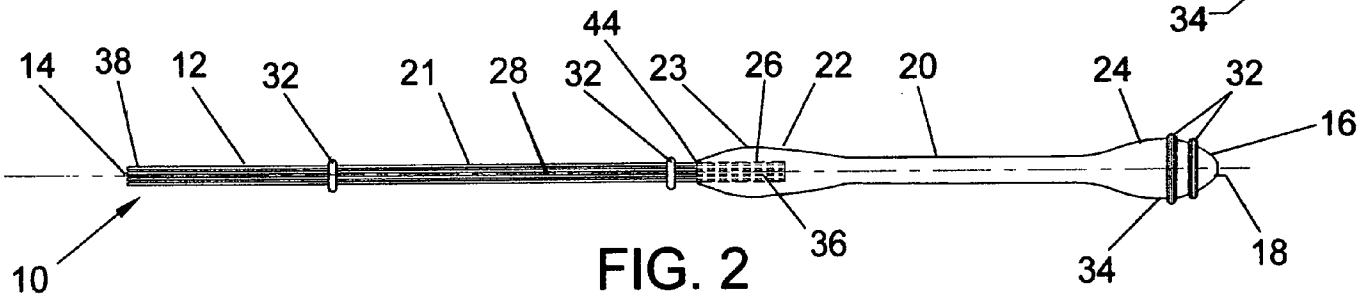
FIG. 2 illustrates a side view of a drumstick according to an embodiment of the invention.
Figure 3:
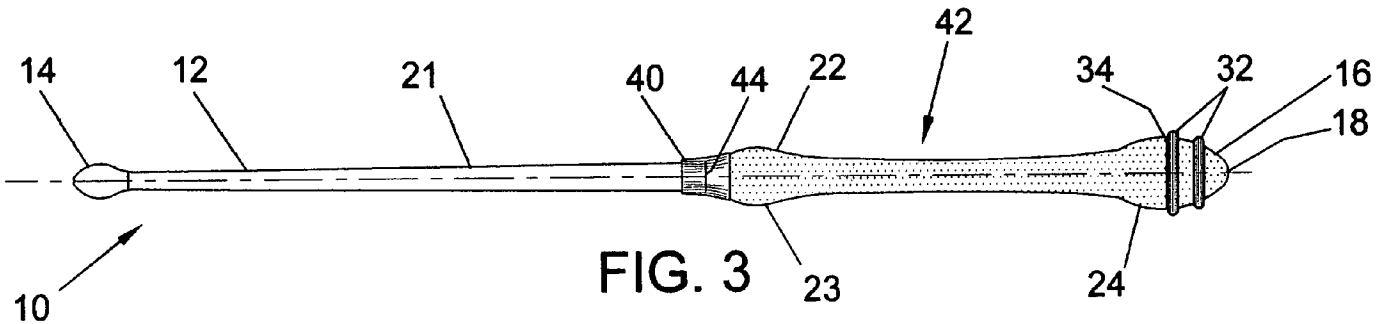
FIG. 3 illustrates a side view of a drumstick according to an embodiment of the invention.

Referring to FIGS. 1 through 3, a drumstick 10 may have an elongated shaft 12 with a contact end 14 and a butt end 16. A portion of the shaft 12 adjacent the butt end 16 may be a handle portion 20 or the general portion of the shaft 12 that a user may hold to use the drumstick 10. The portion of the shaft 12 extending from the handle portion 20 to the contact end 14 may be considered the contact end portion 21. The butt end 16 may taper to a generally pointed tip 18 or a rounded tip 18. The tapering may be a linear diameter reduction or one that may create a curved outer wall shape.

The butt end 16 may have one or more grooves 30 formed therein into which a ring 32, for example, an O-ring made of a rubber like material, may be placed. The O-ring 32 may be formed of synthetic rubber and may have various colors such as black, white, red and the like. The grooves may be formed in the butt end 16 at the location 34 on the shaft 12 where the taper of the butt end 16 begins as well as intermediate the location 34 and the tip 18. Grooves 30 may also be formed in other portions of the elongated shaft 12 such as in the contact end portion 21 and O-ring 32 may be positioned in the grooves 30.

Placement of the grooves 30 and O-ring 32 may reduce vibration in the drumstick 10 when struck on an instrument. This may reduce the shock to the wrist of a user to reduce prolonged wrist strain that may cause physical problems. It has been found that use of three O-rings 32 with one O-ring positioned at location 34 and two others positioned approximately equal distance between location 34 and the tip 18 reduces vibration. The O-rings may also serve to orient a user in gripping the drumstick 10 with their hand. The O-rings may serve to prevent the drumstick from slipping out of a user's hand. The butt end 16 may also be used to strike a drum, cymbal or other instrument. This may produce a different sound with the O-ring striking the instrument, for example, a muted sound on cymbals. Depending on the O-ring 32 material, the O-ring 32 may change the weight to the handle portion 20 that may cause a desired center of balance of the drumstick 10.

The butt end 16 may also be formed of a rubber like material, for example, synthetic rubber. The butt end 16 may be shaped as described; however, the butt end 16 may be of a rubber like material for a more pronounced effect in weight change, vibration characteristics and sound production when used to strike an instrument.

The handle portion 20 may have a larger diameter or raised portion 22 intermediate the butt end 16 and the contact end 14. The raised portion 22 may be placed on the shaft 12 in a location to support use of the thumb of a user of the drumstick 10. This may reduce strain on the thumb and thereby the risk of hand or wrist injury with long term use of the drumstick 10. There may also be a larger diameter element or raised element 24 relative to the shaft 12 diameter and positioned at location 34. This may create a narrower diameter intermediate the raised portion 22 and raised element 24 for a contoured handle portion 20 for gripping by a user. The raised portion 22 may be tapered from a maximum diameter location 23 to merge with the shaft 12. A groove 30 with an O-ring inserted may be positioned at the maximum diameter location 23.

The elongated shaft 12 may also be formed of a handle portion 20 that may have a bore 26 formed therein. Multiple dowel rods 28 may be inserted and attached at a first end 36 in the bore 26, for example, using adhesive. A second end 38 of the dowel rods 28 may form the contact end 14. It has been found that a quantity of 18 dowel rods may allow good sound performance with a drumstick 10. One or more O-rings 32 may be positioned on the dowel rods 28 to modify the sound characteristics when the drumstick 10 may be used to strike an instrument. O-rings as an example may be placed at the edge 44 as well as along the length of the contact end portion 21. A shrink sleeve 40 may also be placed at edge 44.

The handle portion 20 may be painted or coated with a material. A heat shrink sleeve 40 may be attached to the shaft 12 at the location of edge 44 of the interface between the handle portion 20 and contact end portion 21 that may also be the edge of the painted portion 42 of the drumstick 10 to protect the wood and coating interface. The butt end 16 may be painted or coated with a yellow color material and three grooves 30 formed therein with each groove 30 having a black O-ring 32 insert. Other coating colors and O-ring 32 colors may also be used.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for striking an instrument to produce a musical sound comprising;

an elongated shaft having a contact end and a butt end;

said butt end tapered to a pointed tip;

said butt end having a first groove at a location of the beginning of said butt end taper and an O-ring disposed therein; and said butt end having a second groove and a third groove approximately equally spaced apart and intermediate said first groove and said tip; and a second O-ring disposed in said second groove and a third O-ring disposed in said third groove.

2. A device for striking an instrument to produce a musical sound comprising:

an elongated shaft having a contact end and a butt end;

said butt end tapered to a pointed tip;

said butt end having a groove therein;

a handle portion having a raised portion intermediate said contact end and said butt end;

said raised portion disposed on said shaft for contact by a users thumb when said handle portion is gripped; and a raised element disposed on said shaft adjacent said butt tip spaced apart from said raised portion.

3. The device as in claim 2 wherein said raised portion is tapered from a maximum diameter location to merge with said shaft.

4. A device for striking an instrument to produce a musical sound comprising an elongated shaft having a contact end and a butt end;

said butt end tapered to a pointed tip;

said butt end having a groove therein;

a handle portion having a raised portion intermediate said contact end and said butt end;

said handle portion having a bore formed therein with a plurality of dowel rods inserted and attached at a first end in said bore and a second end of said dowel rods forming said contact end;

said raised portion disposed on said handle portion for contact by a users thumb when said handle portion is gripped; and a plurality of O-rings disposed on said plurality of dowel rods.

5. The device as in claim 4 wherein a raised element disposed on said handle portion adjacent said tip.

6. The device as in claim 1 wherein said butt end and a handle portion adjacent said butt end have a surface coating and a heat shrink wrap sleeve is attached over a surface coating edge.

7. The device as in claim 1 wherein said butt end is formed of a synthetic rubber material that is attached to said shaft.

8. The device as in claim 1 wherein said shaft is made of wood.

9. The device as in claim 1 wherein said shaft having a groove therein.

10. The device as in claim 1 wherein said butt end having a surface coating of yellow color and an O-ring of black color in each of said grooves.

* * * * *